US008548363B2

(12) United States Patent
Sasaki

(10) Patent No.: US 8,548,363 B2
(45) Date of Patent: Oct. 1, 2013

(54) DEVELOPING DEVICE AND PROCESS CARTRIDGE

(75) Inventor: Teruhiko Sasaki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 274 days.

(21) Appl. No.: 13/069,703

(22) Filed: Mar. 23, 2011

(65) Prior Publication Data

US 2011/0236079 A1 Sep. 29, 2011

(30) Foreign Application Priority Data

Mar. 25, 2010 (JP) ..... 2010-069913

(51) Int. Cl.
*G03G 15/08* (2006.01)

(52) U.S. Cl.
USPC ..... 399/281; 399/111; 399/258; 399/272

(58) Field of Classification Search
USPC ..... 399/281, 272, 258, 111, 119; 222/DIG. 1
See application file for complete search history.

(56) References Cited

U.S. PATENT DOCUMENTS

| | | | | |
|---|---|---|---|---|
| 5,899,609 | A * | 5/1999 | Wang | 399/281 |
| 6,274,846 | B1 * | 8/2001 | Ono et al. | 219/216 |
| 7,325,385 | B2 | 2/2008 | Nagashima et al. | |
| 8,180,264 | B2 * | 5/2012 | Hasegawa et al. | 399/281 |
| 2003/0026629 | A1 * | 2/2003 | Kawamura et al. | 399/281 |
| 2007/0025762 | A1 * | 2/2007 | Kato et al. | 399/121 |
| 2007/0274744 | A1 * | 11/2007 | Ito et al. | 399/281 |

FOREIGN PATENT DOCUMENTS

| | | | |
|---|---|---|---|
| JP | 8-6372 | A | 1/1996 |
| JP | 2004-317549 | A | 11/2004 |

* cited by examiner

*Primary Examiner* — Sophia S Chen
(74) *Attorney, Agent, or Firm* — Fitzpatrick, Cella, Harper & Scinto

(57) ABSTRACT

A developing device includes a developer accommodating chamber containing a developer; a developer carrying member for carrying the developer to develop an electrostatic image; a feeding belt for feeding the developer toward the developer carrying member by rotation of the driving roller in a stretched state in which the feeding belt is stretched by a driving roller and a follower roller; and a switching mechanism for switching the feeding belt from a loosened state in which the feeding belt is looser than in the stretched state to the stretched state.

16 Claims, 11 Drawing Sheets

(a)

(b)

(a)

(b)

(a)

(b)

DEVELOPING DEVICE AND PROCESS CARTRIDGE

FIELD OF THE INVENTION AND RELATED ART

The present invention relates to a developing device and a process cartridge for an image forming apparatus.

Heretofore, in the image forming apparatus using an electrophotographic image-forming process, it is known that an electrophotographic photosensitive member and process means actable on the electrophotographic photosensitive member are unified into a cartridge, which is detachably mountable to a main assembly of the image forming apparatus. With such a type of apparatus, maintenance operations can be carried out in effect by the user without relying on a service person, and therefore, the operability can be improved remarkably. Such a process cartridge type is used widely in image forming apparatuses.

In view of the recent demand for downsizing of the image forming apparatus, Japanese Laid-open Patent Application Hei 08-006372 proposes a thin-type structure of the developing device contained in the process cartridge. In Japanese Laid-open Patent Application Hei 08-006372, a feeding belt for feeding a developer (toner) and a belt driving means are used for the developing device to comprise a thin-type apparatus. As for a filling method of the toner into a toner accommodating chamber in such a developing device, it is typical that a toner-filling opening is provided in a side wall of the toner accommodating chamber, and the toner is filled through the toner-filling opening, and then, the toner-filling opening is plugged by a closing member.

As for a toner-filling method, for example, the toner is filled through a large filling opening provided in the toner accommodating chamber in a direction perpendicular to a rotation axis direction of the stirring member, and then a closing member is welded to the toner accommodating chamber (Japanese Laid-open Patent Application 2004-317549).

When assembling such an apparatus using the feeding belt as is disclosed in Japanese Laid-open Patent Application Hei 08-006372, however, it is necessary to assemble a driving pulley and a holding pulley in the state that the belt is stretched. In such a case, a difficult assembling operation is necessitated, since the pulleys have to be mounted to the frame of the developing device while stretching the belt against the elastic force thereof by pulling the pulleys away from each other.

It would be considered to use, for formation of the developer (toner) filling port, an upper surface opposing the feeding surface of the feeding belt, in the apparatus of Japanese Laid-open Patent Application Hei 08-006372, and the toner-filling method of Japanese Laid-open Patent Application 2004-317549 is employed. With such a structure, the toner is filled through an opening opposing the feeding surface of the feeding belt, and therefore, the feeding belt impedes the entering toner, with the result that a longer time is required for the toner filling.

SUMMARY OF THE INVENTION

Accordingly, it is a principal object of the present invention to provide a developing device and a process cartridge using a feeding-belt structure wherein the assembling operability is improved.

It is another object of the present invention to provide a developing device and a process cartridge having the same, wherein a developer is filled through an opening opposing a feeding surface of the feeding belt, and therefore, the time required for filling the developer can be reduced.

According to an aspect of the present invention, there is provided a developing device comprising: a developer accommodating chamber containing a developer; a developer carrying member for carrying the developer to develop an electrostatic image; a feeding belt for feeding the developer toward the developer carrying member by rotation of the driving roller in a stretched state in which the feeding belt is stretched by a driving roller and a follower roller; and a switching mechanism for switching the feeding belt from a loosened state in which the feeding belt is looser than in the stretched state to the stretched state.

According to another aspect of the present invention, there is provided a process cartridge detachably mountable to a main assembly of an image forming apparatus. The process cartridge comprises: an image bearing member on which an electrostatic image is to be formed; a developer accommodating chamber containing a developer; a developer carrying member for carrying the developer to develop an electrostatic image; a feeding belt for feeding the developer toward the developer carrying member by rotation of the driving roller in a stretched state in which the feeding belt is stretched by a driving roller and a follower roller; and a switching mechanism for switching the feeding belt from a loosened state in which the feeding belt is looser than in the stretched state to the stretched state.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

The preferred embodiments of the present invention will be described in conjunction with the accompanying drawings. Here, the dimensions, the sizes, the materials, the configurations, the relative positional relationships of the elements in the following embodiments and examples are not restrictive to the present invention unless otherwise stated.

Embodiment 1

Figure 1:
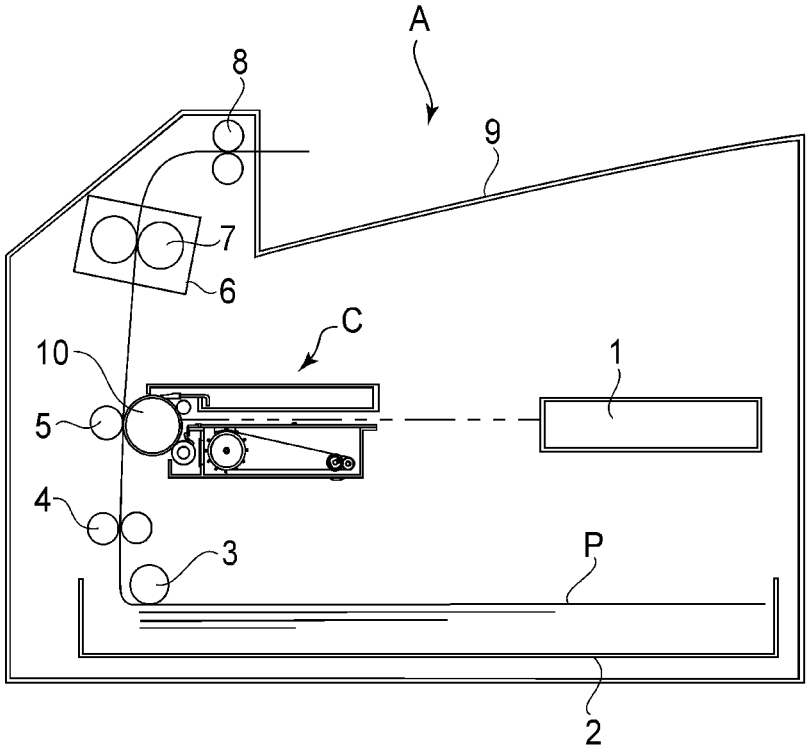
FIG. 1 is a schematic sectional view illustrating structures of a main assembly of the image forming apparatus.
Figure 2:
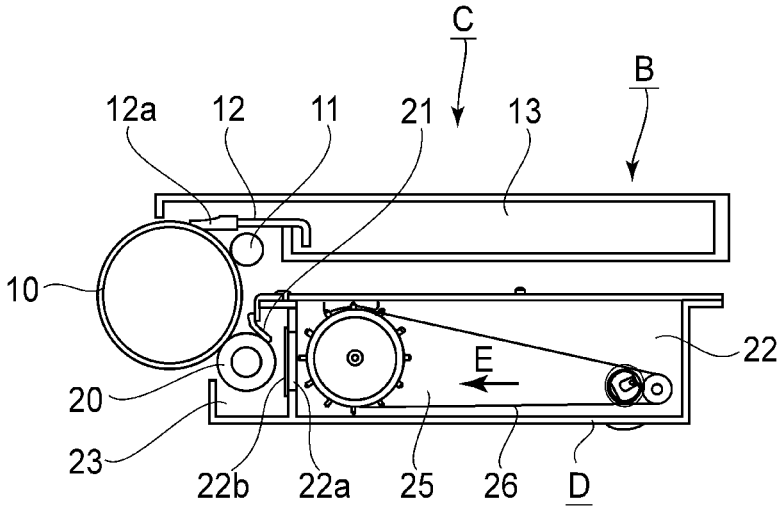
FIG. 2 is a schematic sectional view of a process cartridge.

FIG. 1 is a schematic sectional view illustrating structures of an image forming apparatus including a developing device according to an embodiment of the present invention. FIG. 2 is a schematic sectional view of a process cartridge which is provided with the developing device according to the embodiment of the present invention and which is detachably mountable to a main assembly of the image forming apparatus.

[Image Forming Apparatus]

Referring to FIG. 1, a description will be provided as to the structures of the main assembly A of the image forming apparatus along movement of a recording material P. The main assembly A of the image forming apparatus forms an electrostatic image (latent image) on an image bearing member (photosensitive drum) 10 by a scanner portion 1 on the basis of latent image data, and develops the latent image, by which a toner image is formed on the photosensitive drum 10. A recording material P is fed, one by one, by a sheet feeder 3 from a sheet feeding cassette 2 capable of accommodating a plurality of recording materials P and is fed to registration rollers 4. The toner image is transferred onto the recording material P having been fed from the registration rollers 4, by a transfer roller 5. Subsequently, the recording material P is fed to a fixing portion 6, in which the toner image is fixed by a fixing roller 7. The recording material P carrying the fixed image is discharged to a sheet discharge portion 9 by a discharging portion 8.

[Process Cartridge]

Referring to FIG. 2, the structures of the process cartridge will be described. As shown in FIG. 2, a process cartridge C includes a photosensitive member unit B and a developing device D, which are unified into a cartridge detachably mountable to the main assembly A of the image forming apparatus. The photosensitive member unit B includes the photosensitive drum 10, a charging roller 11 which is a charging means, and a cleaning blade 12 which is cleaning means. The developing device D includes the developing roller (developer carrying member) 20 as developing means, a developer chamber 23 provided with a developing blade 21, toner feeding means 25, a toner accommodating chamber (developer accommodating chamber) 22 containing a developer (toner), and so on. The toner accommodating chamber 22 is provided with an opening 22*a* for communication between the developer chamber 23 and the toner accommodating chamber 22, and the toner is supplied to the developing roller 20 of the developer chamber 23 through the opening 22*a*. The opening 22*a* is closed by a developer seal member 22*b* bonded around the opening 22*a*. The opening 22*a* is sealed before use of the process cartridge C. Upon use, the user grips one end portion of the developer seal member 22*b* and unseals the opening 22*a*, so that the toner can be supplied from the toner accommodating chamber 22 into the developer chamber 23.

In the developing device D, the toner feeding means 25 includes an endless feeding belt 26, which is rotatable, to feed the toner from the toner accommodating chamber 22 (developer accommodating chamber) into the developer chamber 23. The developing roller 20 containing a magnet roller (stationary magnet) is rotated, so that a toner layer is formed on the surface of the developing roller 20, and the toner layer is triboelectrically charged by the function of the developing blade 21. The toner is transferred onto the photosensitive drum 10 in accordance with the latent image by which the toner image is formed. The developing blade 21 is effective to regulate the amount of the toner on the peripheral surface of the developing roller 20 and is effective to apply triboelectric charge.

The photosensitive drum 10, after the toner image is transferred onto the recording material P by the transfer roller 5, is cleaned by the cleaning blade 12 removing the remaining toner from the photosensitive drum 10, so that the photosensitive drum 10 is prepared for the next image-forming process. The cleaning blade 12 includes an elastic blade 12*a* having an edge portion contacted counter directionally to the photosensitive drum 10 and scrapes the residual toner off the photosensitive drum 10 and collects it into a residual toner chamber 13.

[Developing Device]

The developing device D of this embodiment uses the feeding belt 26 as the toner feeding means 25. The structures of the developing device D will be described in the order of assembling. FIGS. 3-12 are schematic views illustrating assembling of the developing device D, wherein the portions particularly relating to the present invention is mainly shown, and the other portions are omitted for better understanding.

<Assembling of Toner Feeding Means>

Figure 3:
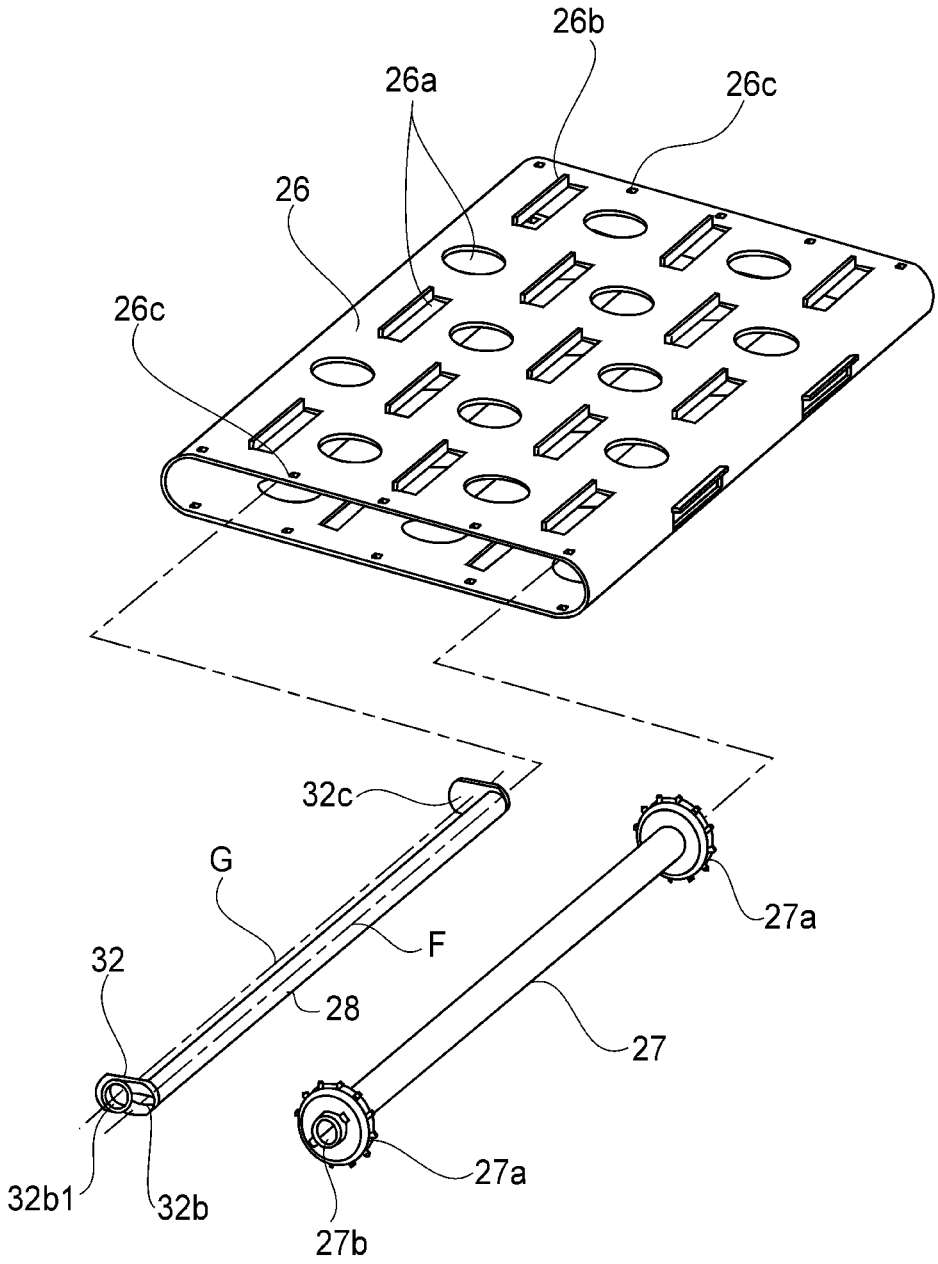
FIG. 3 is a schematic illustration showing the assembling of a driving roller and a follower roller to a feeding belt according to Embodiment 1.
Figure 4:
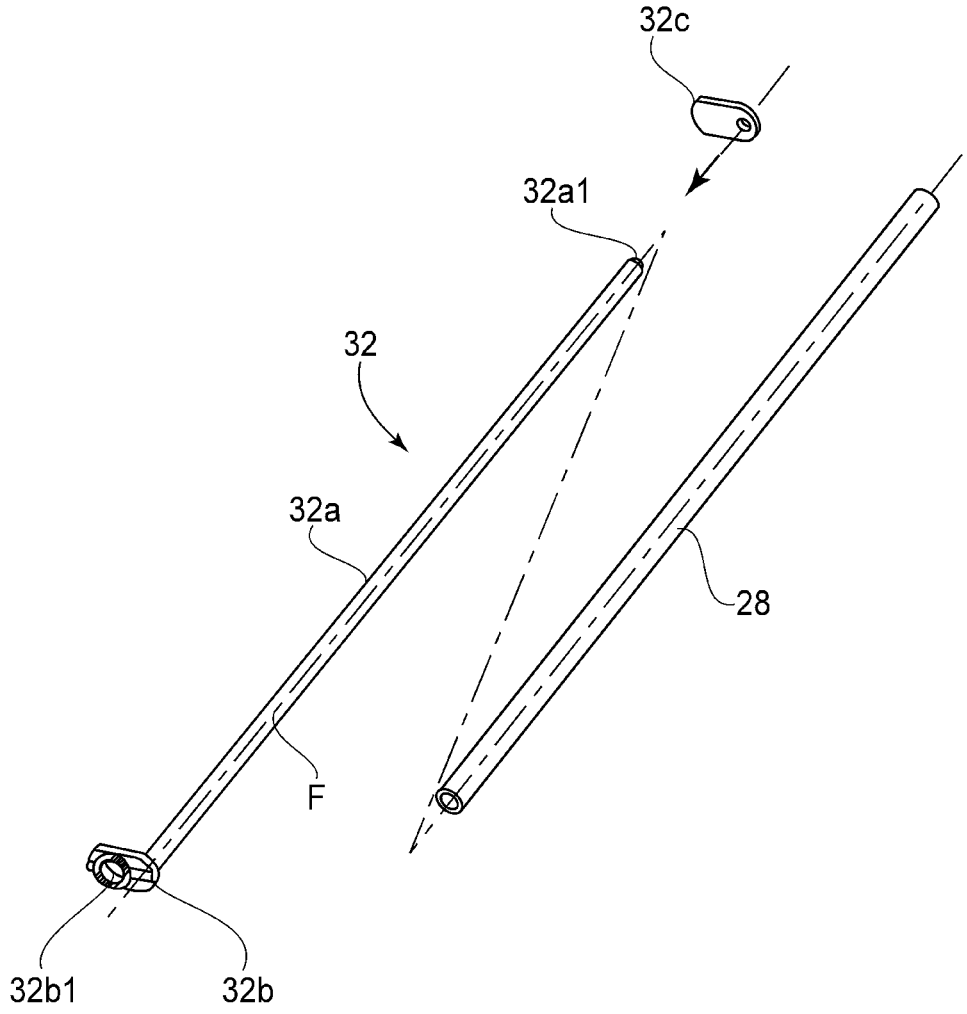
FIG. 4 is a schematic illustration showing the mounting of the follower roller to a supporting member according to Embodiment 1.
Figure 5:
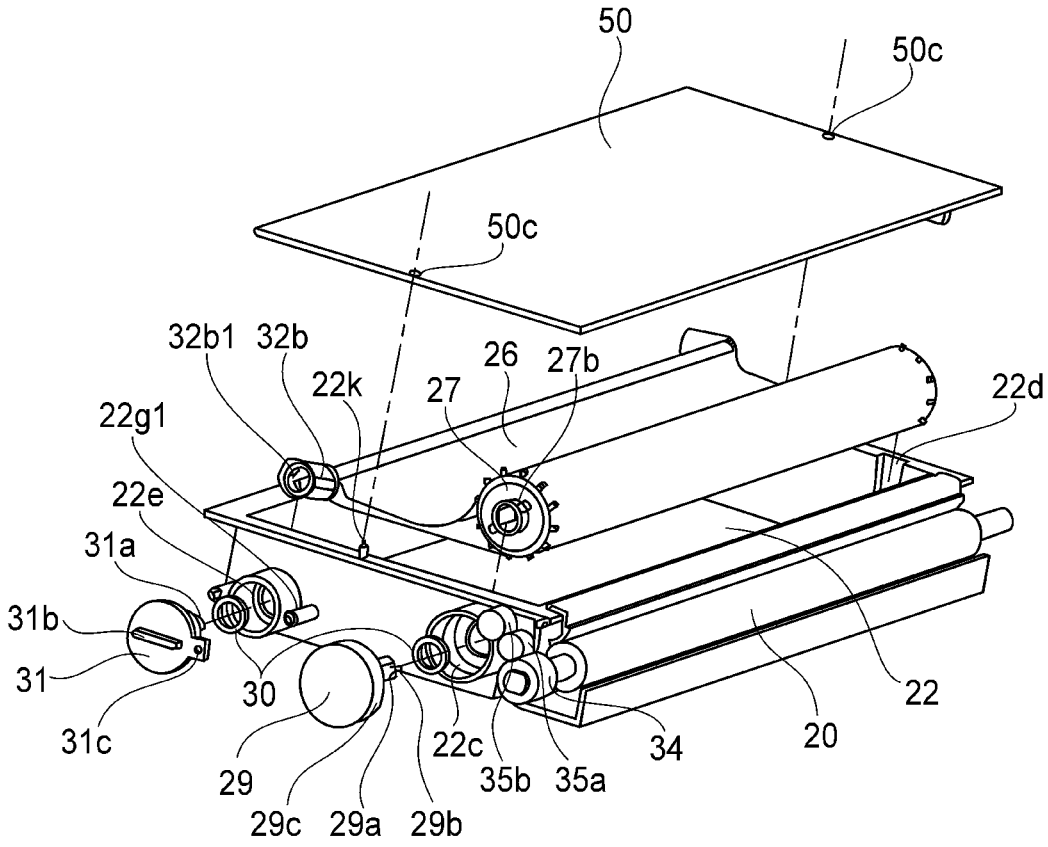
FIG. 5 is a schematic illustration showing the assembling of toner feeding means to a toner accommodating chamber according to Embodiment 1.
Figure 6:
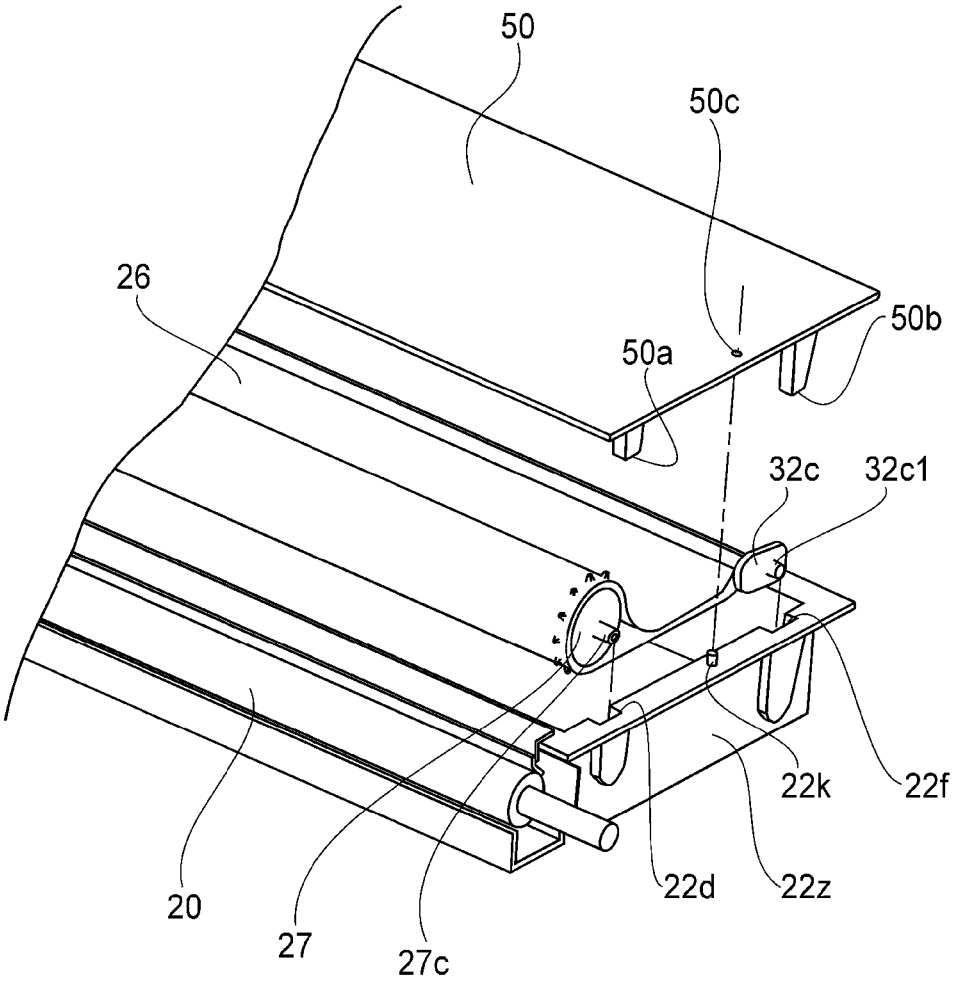
FIG. 6 is a schematic illustration showing the assembling of toner feeding means to a toner accommodating chamber according to Embodiment 1.
Figure 7:
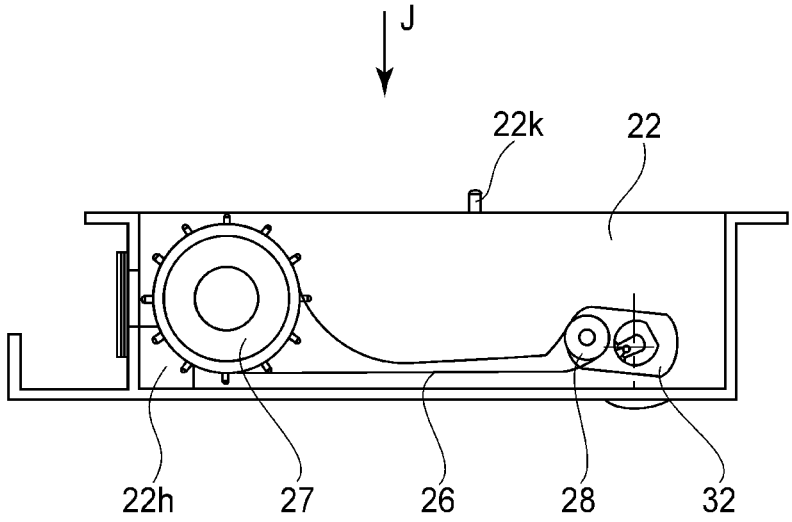
FIGS. 7(*a*) and 7(*b*) are a schematic sectional views illustrating a loosened state and a stretched state of the feeding belt according to Embodiment 1.
Figure 7:
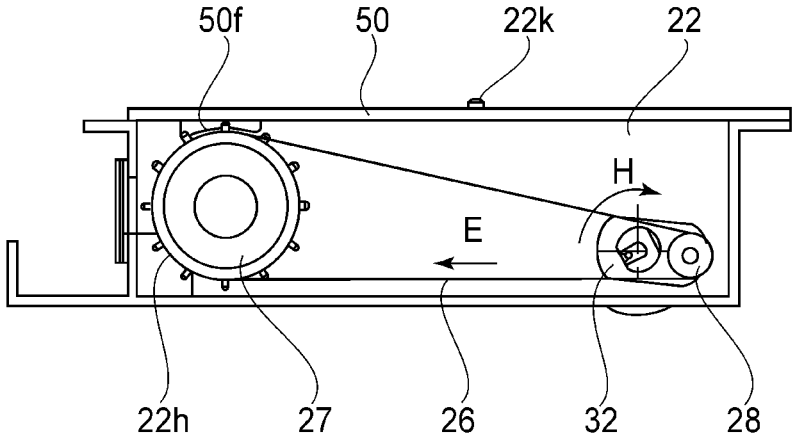
Figure 8:
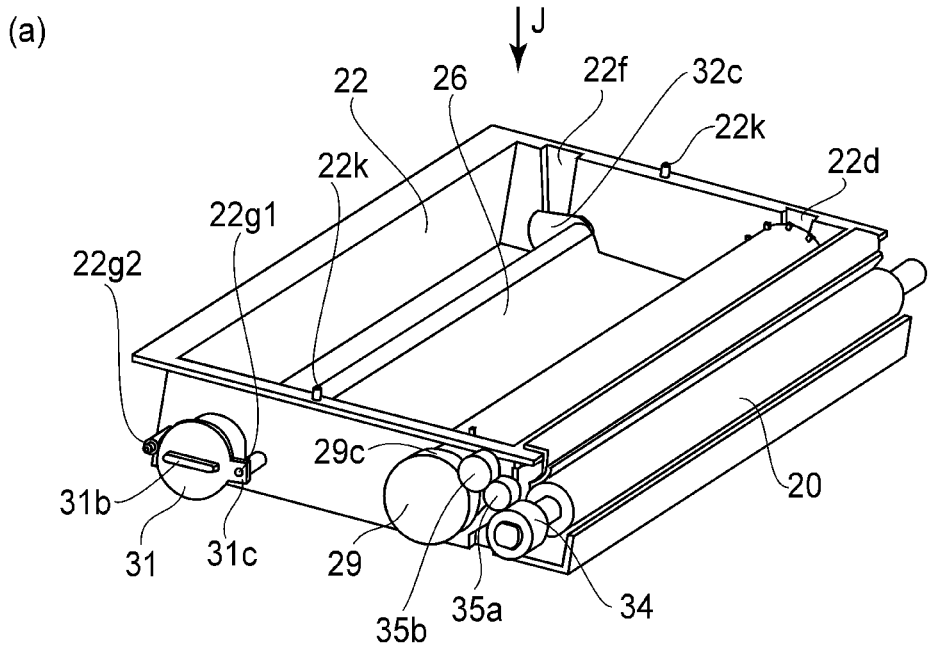
FIGS. 8(*a*) and 8(*b*) are perspective views illustrating fixing means for a follower roller.
Figure 8:
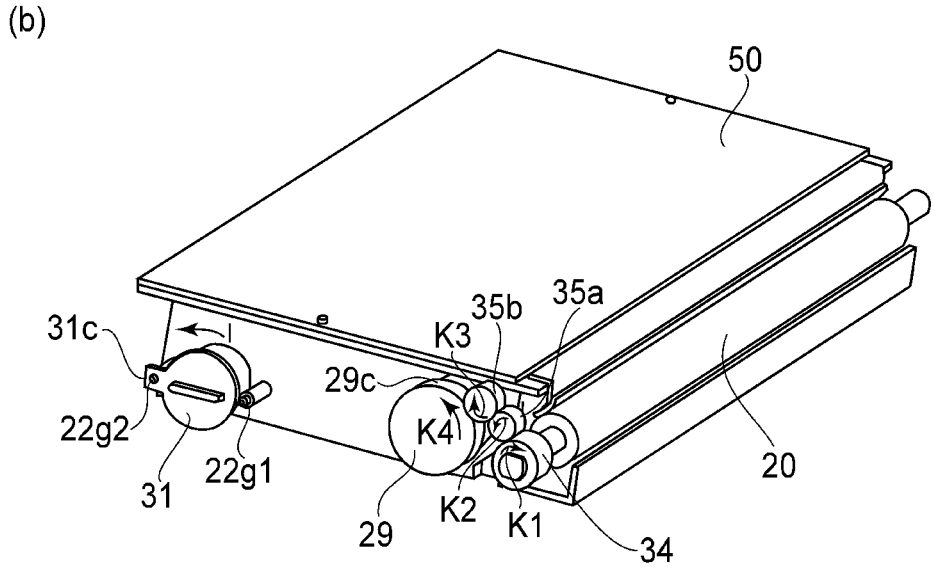
Figure 9:
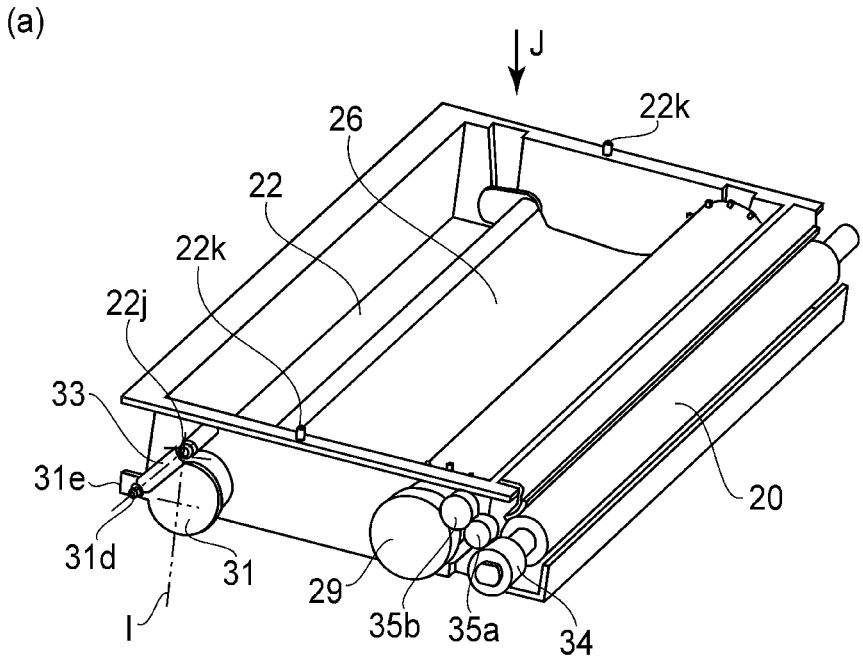
FIGS. 9(*a*) and 9(*b*) are perspective views illustrating another fixing means for the follower roller.
Figure 9:
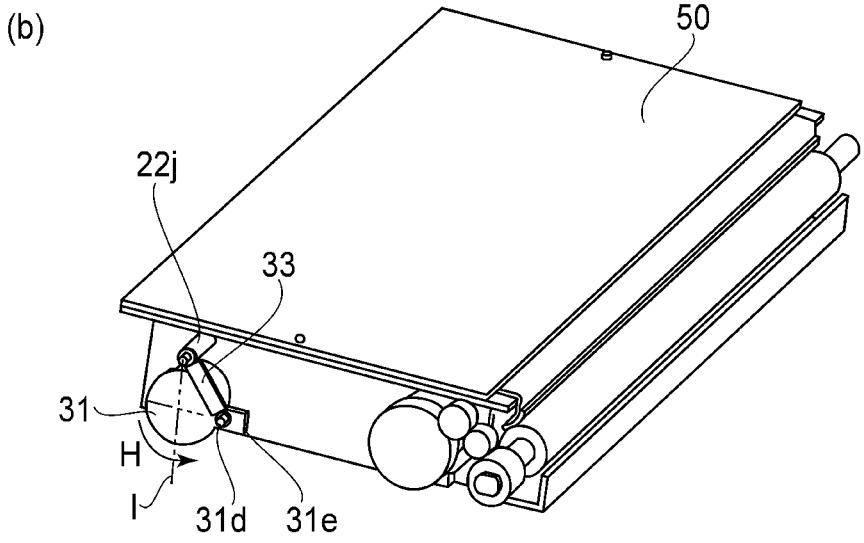

FIG. 3 illustrates the assembling of a driving roller and a follower roller to a feeding belt in the developing device of this embodiment. FIG. 4 is an illustration of the mounting of the follower roller to a supporting member in the developing device according to this embodiment. FIGS. 5 and 6 are illustrations of the mounting of the toner feeding means including the feeding belt into the toner accommodating chamber in the developing device according to this embodiment. FIG. 7 is a sectional view illustrating a loose state and a stretched state of the feeding belt in the developing device according to this embodiment. FIG. 8 is a perspective view illustrating fixing means for the follower roller in the developing device according to this embodiment. FIG. 9 is a perspective view illustrating another fixing means for the follower roller in the developing device according to this embodiment.

As shown in FIG. 3, the driving roller 27 and the follower roller 28 are inserted into the endless feeding belt 26. The feeding belt 26 comprises through-holes 26*a* capable of passing the toner and projections 26*b* capable of feeding and stirring the toner. The through-holes 26*a* and the projections 26*b* are arranged in a staggered manner. The material of the feeding belt 26 is a resin material sheet of polyethylene terephthalate (PET), polycarbonate (PC), or polyphenylene-sulfide resin material (PPS) resin material, for example. The driving roller 27 is provided with a sprocket 27*a* at each of the opposite ends, the sprocket 27*a* is engaged with perforations 26*c* provided at the lateral ends of the feeding belt 26, so that a driving force is transmitted from the driving roller 27 to the feeding belt 26. The follower roller 28 is rotatably supported by the supporting member 32.

As shown in FIG. 4, a shaft portion 32*a* of the supporting member 32 is inserted into the follower roller 28. By this, the follower roller 28 is rotatably supported by an outer periphery of the shaft portion 32*a*, at an inner surface thereof. Thereafter, an end 32*c* is fixed to the shaft portion 32*a*1 so that movement of the follower roller 28 in the longitudinal direction (axial direction) is limited by the ends 32*b*, 32*c*.

Referring to FIG. 5, a description will be provided as to the mounting of the endless feeding belt 26 to the toner accommodating chamber 22 after insertion of the driving roller 27 and the follower roller 28 into the endless feeding belt 26. As described hereinbefore, in the peripheral portion of the opening 22*a* of the toner accommodating chamber 22 the developer seal member 22*b* is mounted. One longitudinal end of the driving roller 27 is supported by the driving roller shaft 29 through a shaft hole 22*c* from an outside of the toner accommodating chamber 22. The connection between the driving roller 27 and the driving roller shaft 29 is accomplished by engagement between a non-circular hole 27*b* provided at one end of the driving roller 27 and a non-circular shaft 29*a* of the driving roller shaft 29 and by engagement between a fixed portion (unshown) of the driving roller 27 and a retention claw 29*b* of the driving roller shaft 29. The non-circular hole here is a generally circular hole which, however, has non-circular portions at diametrically opposite positions, such as diametrically opposite keyways. The non-circular shaft here is a generally circular shaft which, however, has non-circular portions at diametrically opposite positions, such as diametrically opposite keys, which are complementary with the non-circular portions of the non-circular hole, respectively. Between the driving roller shaft 29 and the shaft hole 22*c*, a sealing member 30 is provided. The sealing member 30 prevents toner leakage through the shaft hole 22*c* of the toner accommodating chamber 22.

On the other hand, as shown in FIG. 6, another longitudinal end of the driving roller 27 is provided with an end shaft 27*c*. The end shaft 27*c* of the driving roller 27 is set in a groove portion 22*d*, and is confined by a pushing portion 50*a* of a closing member 50, which will be described hereinafter, so that the driving roller 27 is supported rotatably relative to the toner accommodating chamber 22. A bottom surface (unshown) of the groove portion 22*d* supporting the end shaft 27*c* has a U or V bearing configuration. The driving roller shaft 29 shown in FIG. 5 is provided with an integral gear portion 29*c*, which transmits a driving force received from driving force transmitting means including a gear train which will be described hereinafter, to the driving roller 27.

Referring to FIGS. 4 and 5, mounting of the follower roller 28 will be described. As shown in FIGS. 4 and 5, the follower roller 28 is supported rotatably by the supporting member 32. One longitudinal end of the supporting member 32 is supported by follower roller shaft (switching) 31 through a shaft hole 22*e* from an outside of the toner accommodating chamber 22. A connection state of the supporting member 32 is established by engagement between a non-circular hole 32*b*1 provided at the end of the supporting member 32 and a non-circular shaft 31*a* and by engagement between a fixed portion (unshown) of the supporting member 32 and a retention claw of the follower roller shaft 31. The sealing member 30 is provided between the follower roller shaft 31 and the shaft hole 22*e*. The sealing member 30 prevents toner leakage through the shaft hole 22*e* of the toner accommodating chamber 22.

On the other hand, as shown in FIG. 6, the other longitudinal end of the supporting member 32 is supported by an end shaft 32*c*1 of the shaft end 32*c* of the supporting member 32. The end shaft 32*c*1 is set into a groove portion 22*f* of the toner accommodating chamber 22, and is retained there by a pushing portion 50*b* of the closing member 50, which will be described hereinafter. A bottom surface (unshown) of the groove portion 22*f* supporting the end shaft 32*c*1 has a U or V bearing configuration.

As described in the foregoing, there are shown in FIG. 3 an axis F of the shaft portion 32*a* of the supporting member 32 supporting the follower roller 28 and an axis G connecting a center of the non-circular hole 32*b*1 and a center of the end shaft 32*c*1 of the shaft end 32*c* (FIGS. 3, 4 and 6). The supporting member 32 is rotatable about an axis G different from (parallel with) a rotational axis (axis F) of the follower roller 28. Therefore, by gripping and rotating the rib (grip portion) 31*b* (FIG. 5) of the follower roller shaft (switching portion) 31, the follower roller 28 becomes swingable (rotatable) about the axis G. By this, the follower roller 28 becomes movable between a stretching position for stretching the feeding belt 26 and a loosening position for loosening the feeding belt 26. In this manner, there is provided a switching mechanism for switching the feeding belt from the loose state to the stretched state by the supporting member 32 and the switching portion 31. With this structure, it is possible that after the feeding belt is assembled into the developer accommodating chamber with the loosened state, the feeding belt is switched to the stretched state, and therefore, assembling operability is improved.

Referring to FIGS. 7(*a*) and 7(*b*), a further description will be provided. FIG. 7(*a*) is a sectional view illustrating loose state of the feeding belt 26. FIG. 7(*b*) is a sectional view illustrating a stretched state of the feeding belt 26. When rotating the follower roller in the direction of an arrow H, the follower roller 28 swings, by which the feeding belt 26 is stretched between the driving roller 27 and the follower roller 28. The bottom surface of the toner accommodating chamber 22 is provided with a rib 22*h* so that the hole portions 26*c* of the feeding belt 26 does not disengage from the sprocket 27*a* when the feeding belt 26 is in the loose state. Similarly, a rib 50*f* of the closing member 50 is provided to prevent the hole portions 26*c* of the feeding belt 26 from disengaging from the sprocket 27*a*. The rib 22*h* and the rib 50*f* are disposed adjacent to the sprocket 27*a* at a position not interfering with the through-hole 26*a* of the feeding belt 26 and the projection 26*b* with respect to the longitudinal direction.

Referring to FIG. 5 and FIGS. 8(*a*) and 8(*b*), fixing means for the follower roller 28 will be described. FIG. 8(*a*) illustrates a type in which the feeding belt 26 is fixed in the loosened state. FIG. 8(*b*) illustrates a type in which the feeding belt 26 is fixed in the stretched state. In order to retain the loosened state of the feeding belt 26, a rotation regulating portion 31*c*, which is a through-hole formed integrally with the follower roller shaft 31, is engaged with a boss 22*g*1 provided on a side wall of the toner accommodating chamber 22. By pulling the follower roller shaft 31 in the longitudinal direction, the rotation regulating portion 31*c* is disengaged from the boss 22*g*1. Then, by gripping the rib 31*b* of the follower roller shaft 31 and rotating it in the direction of H, the feeding belt 26 is stretched. An appropriate play is provided between the follower roller shaft 31 and the supporting member 32 so that the follower roller 28 does not move in the longitudinal direction when pulling the follower roller shaft 31. In order to retain the stretched state, the rotation regulating portion 31*c* of the follower roller shaft 31 is fixed by engaging it with a boss 22*g*2 provided to the side wall of the toner accommodating chamber 22. By this, the feeding belt 26 can be fixed in the loosened state and in the stretched state, and therefore, the movement of the feeding belt 26 during an assembling operation of the developing device D can be prevented.

FIGS. 9(*a*) and 9(*b*) are perspective views illustrating another structure of the fixing means for the follower roller. FIG. 9(*a*) is a perspective view illustrating a type in which the feeding belt 26 is urged in the loosened state. FIG. 9(*b*) is a perspective view illustrating a type in which the feeding belt 26 is urged in the stretched state. A tension spring 33, which is an urging means, is stretched between a boss 31*d* of the follower roller shaft 31 and a boss 22*j* of the toner accommodating chamber 22. By this, in the loose state of the feeding belt 26, the follower roller 28 is urged to the bottom surface of the toner accommodating chamber 22. In order to move the follower roller 28 to the position for stretching the feeding belt 26, a grip portion 31*e* of the follower roller shaft 31 is gripped, and the follower roller shaft 31 is rotated in the direction of arrow H. Upon the boss 31*d* of the follower roller shaft 31 passing an axis I connecting a center of the boss 22*j* of the toner accommodating chamber 22 and the rotation axis of the follower roller shaft 31, the feeding belt 26 is stretched by an urging force of the tension spring 33. By this, the follower roller 28 becomes capable of being urged to the stretching position. With such a structure, a variation in the circumferential length of the feeding belt 26 due to a tolerance can be accommodated, and therefore, the feeding belt 26 can be stretched assuredly.

<Drive Transmission of Toner Feeding Means>

Referring to FIG. 7 (*b*) and FIG. 8 (*b*), a drive structure for the toner feeding means 25 will be described. A driving force is transmitted from an unshown driving source of the main assembly A of the image forming apparatus to a drum gear (unshown) provided on the longitudinal end of the photosensitive drum 10. As shown in FIG. 8(*a*) and FIG. 8 (*b*), the driving force is transmitted by the engagement between the developing roller gear 34 provided at the longitudinal end portion of the developing roller 20 and the drum gear (unshown), and is reduced in speed by the idler gears 35*a*, 35*b*, and is transmitted to the gear portion 29*c* of the driving roller shaft 29. The driving of the driving roller shaft 29 is transmitted from the driving roller 27 to the feeding belt 26 by engagement between the sprockets 27*a* and the hole portion 26*c* of the feeding belt 26. In order to prevent deviation of the feeding belt 26 in the longitudinal direction of the follower roller 32 when the driving force is transmitted to the feeding belt 26, it is desirable that the follower roller 32 is crowned or reversely crowned, that is, the diameter changes in the longitudinal direction. With the crown configuration, an outer diameter of the follower roller 32 is smaller in the opposite end portions than in a central portion with respect to the longitudinal direction, and with reverse crown configuration, an outer diameter of the follower roller 32 is larger in the opposite end portions than in a central portion. The configurations are not restrictive to the present invention, if the deviation of the feeding belt 26 can be prevented. The rotational moving direction of the developing roller gear 34 is indicated by an arrow K1, the rotational moving direction of the idler gear 35*a* is K2, the rotational moving direction of the idler gear 35*b* is K3, and the rotational moving direction of the driving roller shaft 29 is K4. As shown in FIG. 7 (*b*), the rotational moving direction of the feeding belt 26 is E. The toner in the toner accommodating chamber 22 is stirred and fed in the direction of E by the feeding belt 26.

<Toner Filling Process>

Referring to FIGS. 7(*a*) and 7(*b*), and FIGS. 8(*a*) and 8(*b*), the toner filling step will be described. As described hereinbefore, the feeding belt 26 can be in the loose state and in the stretched state by the swing operation of the follower roller 28. An upper surface of the toner accommodating chamber 22 in the feeding surface side of the feeding belt 26 (region adjacent the feeding surface) is opened so wide that substantially the entirety of the toner feeding means 25 is exposed as a filling opening. When filling the toner into the toner accommodating chamber 22, the feeding belt 26 is in the loose state, and the toner is filled in the direction of an arrow J (FIG. 7 (*a*) FIG. 8 (*a*)), that is, through the filling opening of the toner accommodating chamber 22. Since the feeding belt 26 in the loose state provides space of the toner accommodating chamber 22, the toner filling is completed quickly. After completion of the toner filling, a boss 22*k* of the toner accommodating chamber 22 is engaged with a positioning hole 50*c* of the closing member 50 to position the closing member 50 to the toner accommodating chamber 22. Thereafter, the closing member 50 is fixed to the toner accommodating chamber 22 by welding or bonding, thus, hermetically sealing the filling opening of the toner accommodating chamber 22.

Then, the rib 31*b* of the follower roller shaft (switching portion) 31 is gripped, and is rotated in the direction of H, by which the feeding belt 26 becomes stretched. When the feeding belt 26 in the loose state is stretched in the state that the toner is filled in the toner accommodating chamber 22, a vibration may be imparted to the toner accommodating chamber 22. By doing so, the toner moves through the through-holes 26*a* of the feeding belt 26, and therefore, the required rotational torque to the follower roller shaft 31 at time of stretching feeding belt 26 can be reduced.

As described in the foregoing, in the structure using the feeding belt 26 for the thin-type developing device D, the toner filling is carried out in the state that feeding belt 26 is loose, and therefore, the toner filling time can be reduced.

If the improvement only in the assembling property is intended, the filling opening for the toner may be holes provided in a part of the side wall (22*z* in FIG. 6) of the developer accommodating chamber 22. With such a structure, after the loosened feeding belt is set, the feeding belt is stretched by the switching mechanism, and thereafter, the toner is filled through the filling opening provided in the side wall, and then, the filling opening is plugged or capped.

In this embodiment, the electrophotographic photosensitive member and the charging means, the developing means or the cleaning means are unified into a cartridge, but the present invention is not limited to such an example. For example, the developing device D and the photosensitive member unit B may be detachably mountable to the main assembly A of the image forming apparatus individually.

Embodiment 2

Figure 10:
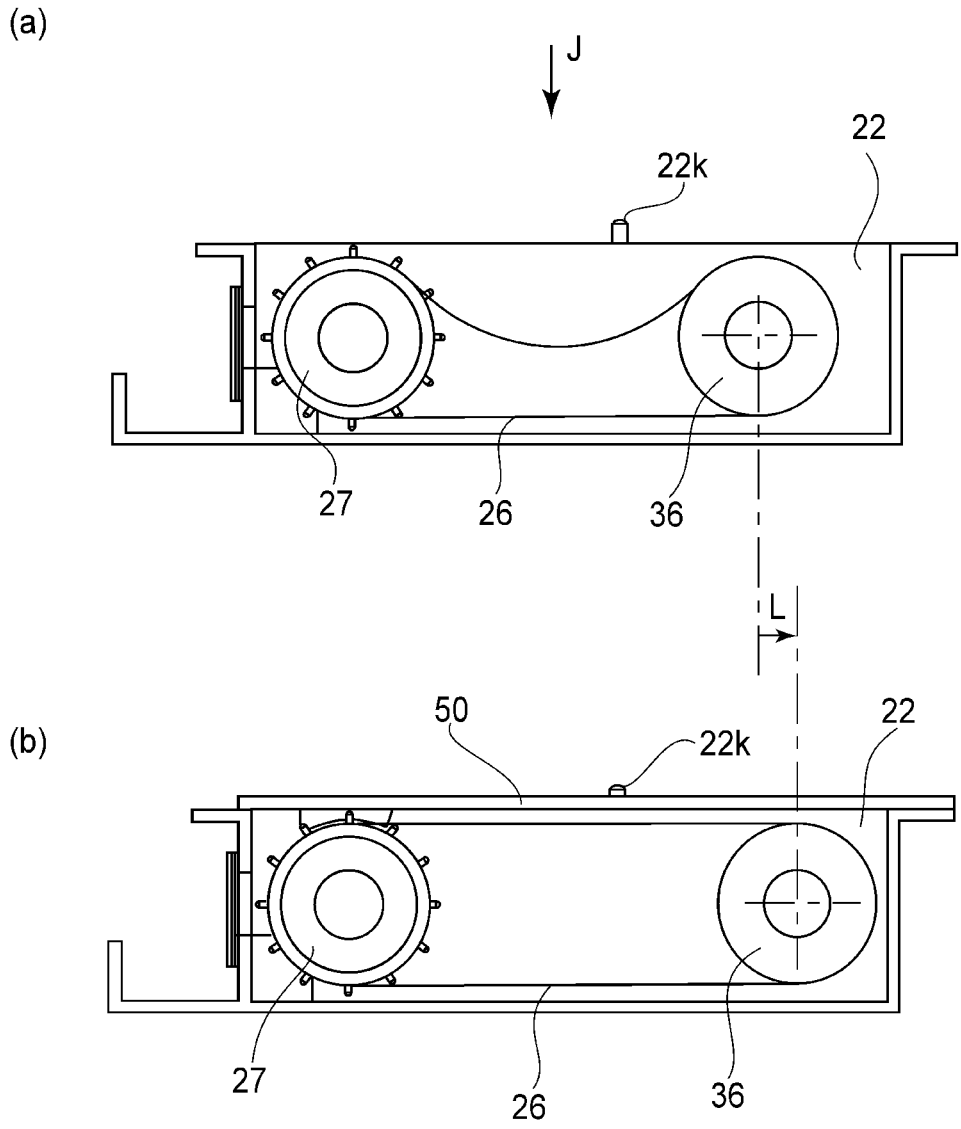
FIGS. 10(*a*) and 10(*b*) are schematic sectional views illustrating a loosened state and a stretched state of the feeding belt according to Embodiment 1.
Figure 11:
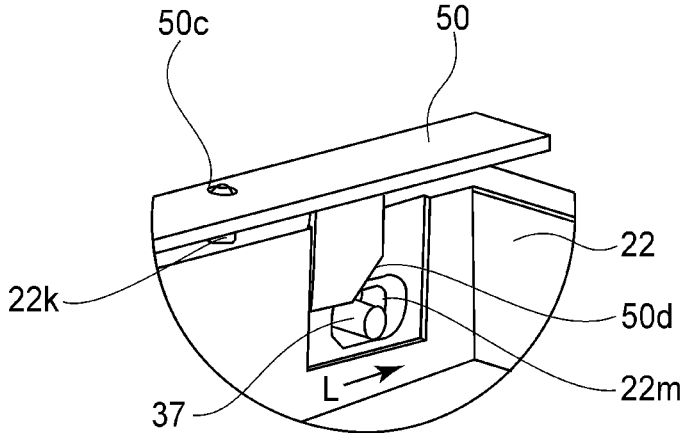
FIGS. 11(*a*) and 11(*b*) are perspective views illustrating a moving method for the follower roller.
Figure 11:
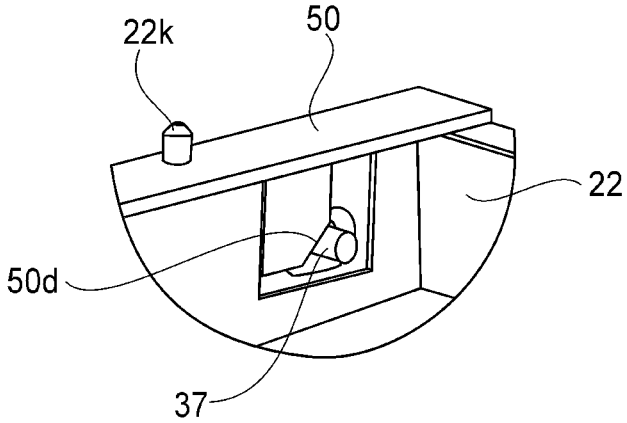

Referring to FIGS. 10(*a*), 10(*b*), 11(*a*), and 11(*b*), a toner feeding means for a developing device according to Embodiment 2 of the present invention will be described. FIGS. 10(*a*) and 10(*b*) are sectional views illustrating a loose state and a stretched state of a feeding belt in the developing device, according to Embodiment 2. FIGS. 11(*a*) and 11(*b*) are perspective views illustrating a moving method for a follower roller in Embodiment 2. In the description of this embodiment, the same reference numerals as in Embodiment 1 are assigned to the elements having the corresponding functions in this embodiment, and the detailed description thereof is omitted for simplicity.

As shown in FIGS. 10(*a*) and 10(*b*), the follower roller 36 moves from a position in FIG. 10(*a*) to a position in FIG. 10(*b*) in the direction of arrow L, by which the feeding belt 26 is stretched. The opposite ends of the shaft 37 of the follower roller 36 (only one shaft end of the follower roller is shown in FIGS. 11(*a*) and 11(*b*), but the structures are the same) are guided by guide portions 22*m* of the toner accommodating chamber 22. When the feeding belt 26 is in the loose state, the toner is filled into the toner accommodating chamber 22 in the direction of an arrow J (FIG. 10(*a*)). As shown in FIG. 11(*a*), a boss 22*k* of the toner accommodating chamber 22 is engaged with a positioning hole 50*c* of a closing member 50 to position the closing member 50 to the toner accommodating chamber 22. Simultaneously with the engagement, the opposite ends 37 of the follower roller 36 are pushed in the direction of an arrow L by an inclined surface (roller movable portion) 50*d* of the closing member 50, so that the follower roller 36 moves to stretch the loose feeding belt 26. Thereafter, the closing member 50 is fixed to the toner accommodating chamber 22 and sealed by welding, bonding or the like. In this embodiment, the switching mechanism includes the guide portion 22*m* and the inclined surface 50*d*.

As described in the foregoing, with such a structure using the feeding belt 26 in the thin-type developing device D, when the closing member 50 is mounted to the toner accommodating chamber 22, the loosened feeding belt 26 can be stretched with an operation of sealing the filling opening by the closing member 50. By doing so, the toner-filling time can be reduced, and the assembling time of the developing device D can also be reduced. If the improvement only in the assembling property is intended, the filling opening for the toner may be holes provided in a part of the side wall of the developer accommodating chamber 22. With such a structure, after the loosened feeding belt is set, the feeding belt is stretched by the inclined surface 50*d*, and thereafter, the toner is filled through the filling opening provided in the side wall, and then, the filling opening is plugged or capped.

Embodiment 3

Figure 12:
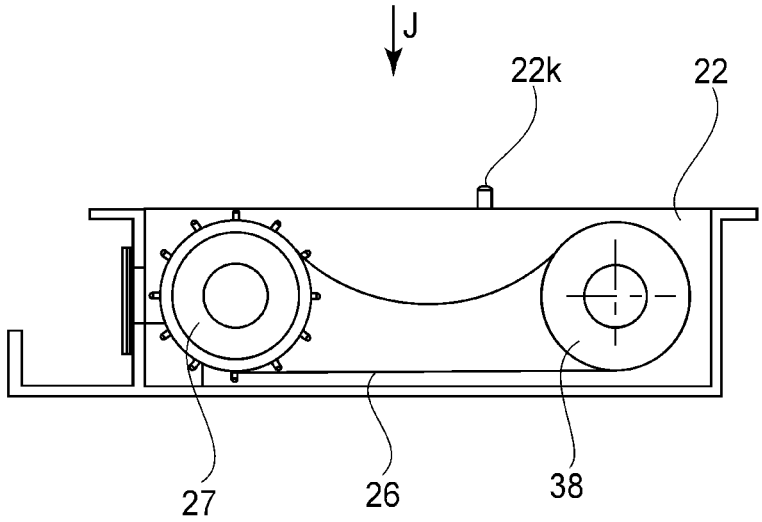
FIGS. 12(*a*) and 12(*b*) are schematic sectional views illustrating a loosened state and a stretched state of the feeding belt according to Embodiment 1.
Figure 12:
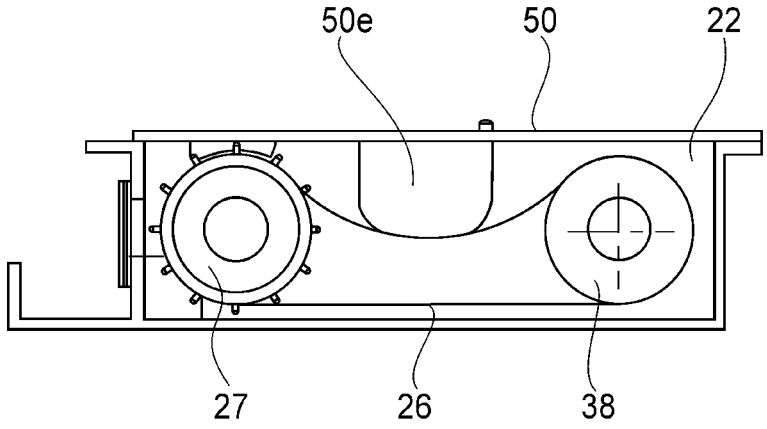

Referring to FIGS. 12(*a*) and 12(*b*), a toner feeding means according to Embodiment 3 will be described. FIGS. 12(*a*) and 12(*b*) are sectional views illustrating a loose state and the stretched state of the feeding belt. In the description of this embodiment, the same reference numerals as in Embodiments 1 and 2 are assigned to the elements having the corresponding functions in this embodiment, and the detailed description thereof is omitted for simplicity.

As shown in FIGS. 12(*a*) and 12(*b*), a feeding belt 26 is trained around a driving roller 27 and a follower roller 38. The follower roller 38 is rotatably mounted to a toner accommodating chamber 22. When the feeding belt 26 is in the loose state, the toner is filled into the toner accommodating chamber 22 in the direction of an arrow J (FIG. 12(*a*)). After completion of the filling, a closing member 50 is fixed by welding and bonding to the toner accommodating chamber 22 to seal the toner accommodating chamber 22. The closing member 50 includes a rib (urging portion) 50*e* which is parallel with a feeding direction of the feeding belt 26. When the closing member 50 is fixed to the toner accommodating chamber 22, the rib 50*e* is contacted to the feeding belt 26 to stretch the feeding belt 26. In this embodiment, the switching mechanism includes the rib 50*e*.

The rib 50*e* is disposed at a position not interfering with a projection 26*b* and a through-hole 26*a* of the feeding belt 26 with respect to the longitudinal direction. The rib 50*e* may be disposed at each of a plurality of positions with respect to the longitudinal direction. The configuration of the rib 50*e* may be any configuration, as long as it can apply a sufficient tension to the feeding belt 26.

As described in the foregoing, with such a structure using a feeding belt for a thin-type developing device, when mounting the closing member 50 to the toner accommodating chamber 22, the loose feeding belt 26 can be stretched with an operation of sealing the filling opening by the closing member 50. By doing so, the toner-filing time can be reduced, and the assembling time of the developing device D can also be reduced. If the improvement only in the assembling property is intended, the filling opening for the toner may be holes provided in a part of the side wall of the developer accommodating chamber 22. With such a structure, the feeding belt is mounted in the loosened state, and then it is stretched by the rib 50*e*, and thereafter, the toner is filled through the filling opening provided in the side wall, and subsequently, the filling opening is plugged or capped.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 069913/2010 filed Mar. 25, 2010 which is hereby incorporated by reference.

What is claimed is:

1. A developing device comprising:

a developer accommodating chamber containing a developer;

a developer carrying member for carrying the developer to develop an electrostatic image;

a feeding belt for feeding the developer toward said developer carrying member by rotation of a driving roller while in a stretched state in which said feeding belt is stretched by said driving roller and a follower roller; and a switching mechanism for switching said feeding belt from a loosened state in which said feeding belt is looser than in the stretched state to the stretched state, wherein said switching mechanism is capable of moving said follower roller between a loosening position for establishing the loosened state of said feeding belt and a stretching position for establishing the stretched state of said feeding belt.

2. A device according to claim 1, wherein said switching mechanism includes a supporting member rotatably supporting said follower roller and rotatable about a rotational axis which is different from a rotational axis of said follower roller, and a switching portion provided outside said developer accommodating chamber and connected with said supporting member, said switching portion being rotatable to rotate said supporting member to move said follower roller.

3. A device according to claim 2, further comprising fixing means for fixing said switching portion to fix said follower roller at the stretching position.

4. A device according to claim 1, wherein said switching mechanism includes:

a supporting member rotatably supporting said follower roller and rotatable about a rotational axis which is different from a rotational axis of said follower roller;

a switching portion provided outside said developer accommodating chamber and connected with said supporting member, said switching portion being rotatable to rotate said supporting member to move said follower roller; and an urging portion for urging said switching portion to urge said follower roller to the stretching position.

5. A device according to claim 1, wherein said driving roller is provided with a plurality of projections at each of opposite axial end portions thereof, and said feeding belt is provided with a plurality of holes at each of opposite end portions thereof, and wherein a driving force is transmitted from said driving roller to said feeding belt through engagement between said projections and said holes, respectively.

6. A developing device comprising:

a developer accommodating chamber containing a developer;

a developer carrying member for carrying the developer to develop an electrostatic image;

a feeding belt for feeding the developer toward said developer carrying member by rotation of a driving roller while in a stretched state in which said feeding belt is stretched by said driving roller and a follower roller; and a switching mechanism for switching said feeding belt from a loosened state in which said feeding belt is looser than in the stretched state to the stretched state, wherein said developer accommodating chamber is provided with an opening for filling the developer into said developer accommodating chamber in a region opposing a feeding surface of said feeding belt, and wherein said switching mechanism maintains the loosened state of said feeding belt while the developer is filled in said developer accommodating chamber, and after the filling of the developer is completed, said feeding belt is switched to the stretched state.

7. A developing device comprising:

a developer accommodating chamber containing a developer;

a developer carrying member for carrying the developer to develop an electrostatic image;

a feeding belt for feeding the developer toward said developer carrying member by rotation of a driving roller while in a stretched state in which said feeding belt is stretched by said driving roller and a follower roller;

a switching mechanism for switching said feeding belt from a loosened state in which said feeding belt is looser than in the stretched state to the stretched state;

an opening which is provided in a region of said developer accommodating chamber opposing a feeding surface of said feeding belt and through which the developer can be filled into said developer accommodating chamber; and a closing member for hermetically closing said opening, wherein said follower roller is movable between a loosening position for establishing the loosened state of said feeding belt and a stretching position for establishing the stretched state of said feeding belt, and wherein said switching mechanism includes a roller movable portion, provided on said closing member, for moving said follower roller to the stretching position with an operation of closing said opening.

8. A developing device comprising:

a developer accommodating chamber containing a developer;

a developer carrying member for carrying the developer to develop an electrostatic image;

a feeding belt for feeding the developer toward said developer carrying member by rotation of a driving roller while in a stretched state in which said feeding belt is stretched by said driving roller and a follower roller;

a switching mechanism for switching said feeding belt from a loosened state in which said feeding belt is looser than in the stretched state to the stretched state;

an opening which is provided in a region of said developer accommodating chamber opposing a feeding surface of said feeding belt and through which the developer can be filled into said developer accommodating chamber; and a closing member for hermetically closing said opening, wherein said switching mechanism includes an urging portion, provided on said closing member, for applying a tension to said feeding belt with an operation of closing said opening.

9. A process cartridge detachably mountable to a main assembly of an image forming apparatus, said process cartridge comprising:

an image bearing member on which an electrostatic image is to be formed;

a developer accommodating chamber containing a developer;

a developer carrying member for carrying the developer to develop an electrostatic image;

a feeding belt for feeding the developer toward said developer carrying member by rotation of a driving roller while in a stretched state in which said feeding belt is stretched by said driving roller and a follower roller; and a switching mechanism for switching said feeding belt from a loosened state in which said feeding belt is looser than in the stretched state to the stretched state, wherein said switching mechanism is capable of moving said follower roller between a loosening position for establishing the loosened state of said feeding belt and a stretching position for establishing the stretched state of said feeding belt.

10. A process cartridge according to claim 9, wherein said switching mechanism includes a supporting member rotatably supporting said follower roller and rotatable about a rotational axis which is different from a rotational axis of said follower roller, and a switching portion provided outside said developer accommodating chamber and connected with said supporting member, said switching portion being rotatable to rotate said supporting member to move said follower roller.

11. A process cartridge according to claim 10, further comprising fixing means for fixing said switching portion to fix said follower roller at the stretching position.

12. A process cartridge according to claim 9, further comprising:

a supporting member rotatably supporting said follower roller and rotatable about a rotational axis which is different from a rotational axis of said follower roller;

a switching portion provided outside said developer accommodating chamber and connected with said supporting member, said switching portion being rotatable to rotate said supporting member to move said follower roller; and an urging portion for urging said switching portion to urge said follower roller to the stretching position.

13. A process cartridge according to claim 9, wherein said driving roller is provided with a plurality of projections at each of opposite axial end portions thereof, and said feeding belt is provided with a plurality of holes at each of opposite end portions thereof, and wherein a driving force is transmitted from said driving roller to said feeding belt through engagement between said projections and said holes, respectively.

14. A process cartridge detachably mountable to a main assembly of an image forming apparatus, said process cartridge comprising:

an image bearing member on which an electrostatic image is to be formed;

a developer accommodating chamber containing a developer;

a developer carrying member for carrying the developer to develop an electrostatic image;

a feeding belt for feeding the developer toward said developer carrying member by rotation of a driving roller while in a stretched state in which said feeding belt is stretched by said driving roller and a follower roller; and a switching mechanism for switching said feeding belt from a loosened state in which said feeding belt is looser than in the stretched state to the stretched state, wherein said developer accommodating chamber is provided with an opening for filling the developer into said developer accommodating chamber in a region opposing a feeding surface of said feeding belt, and wherein said switching mechanism maintains the loosened state of said feeding belt while the developer is filled in said developer accommodating chamber, and after the filling of the developer is completed, said feeding belt is switched to the stretched state.

15. A process cartridge detachably mountable to a main assembly of an image forming apparatus, said process cartridge comprising:

an image bearing member on which an electrostatic image is to be formed;

a developer accommodating chamber containing a developer;

a developer carrying member for carrying the developer to develop an electrostatic image;

a feeding belt for feeding the developer toward said developer carrying member by rotation of a driving roller while in a stretched state in which said feeding belt is stretched by said driving roller and a follower roller;

a switching mechanism for switching said feeding belt from a loosened state in which said feeding belt is looser than in the stretched state to the stretched state;

an opening which is provided in a region of said developer accommodating chamber opposing a feeding surface of said feeding belt and through which the developer can be filled into said developer accommodating chamber; and a closing member for hermetically closing said opening, wherein said follower roller is movable between a loosening position for establishing the loosened state of said feeding belt and a stretching position for establishing the stretched state of said feeding belt, and wherein said switching mechanism includes a roller movable portion, provided on said closing member, for moving said follower roller to the stretching position with an operation of closing said opening.

16. A process cartridge detachably mountable to a main assembly of an image forming apparatus, said process cartridge comprising:

an image bearing member on which an electrostatic image is to be formed;

a developer accommodating chamber containing a developer;

a developer carrying member for carrying the developer to develop an electrostatic image;

a feeding belt for feeding the developer toward said developer carrying member by rotation of a driving roller while in a stretched state in which said feeding belt is stretched by said driving roller and a follower roller;

a switching mechanism for switching said feeding belt from a loosened state in which said feeding belt is looser than in the stretched state to the stretched state;

an opening which is provided in a region of said developer accommodating chamber opposing a feeding surface of said feeding belt and through which the developer can be filled into said developer accommodating chamber; and a closing member for hermetically closing said opening, wherein said switching mechanism includes an urging portion, provided on said closing member, for applying a tension to said feeding belt with an operation of closing said opening.

* * * * *